United States Patent [19]

Ohishi et al.

[11] Patent Number: 4,943,164

[45] Date of Patent: Jul. 24, 1990

[54] MIXING APPARATUS FOR MIXING REAGENT FOR USE IN AUTOMATIC CHEMISTRY ANALYZER

[75] Inventors: Tadashi Ohishi; Hiroshi Umetsu, both of Katsuta, Japan

[73] Assignee: Hitachi, Ltd., Tokyo, Japan

[21] Appl. No.: 391,997

[22] Filed: Aug. 10, 1989

[30] Foreign Application Priority Data

Aug. 26, 1988 [JP] Japan ..... 63-210746

[51] Int. Cl.[5] ..... B01F 11/00; B01F 15/06

[52] U.S. Cl. ..... 366/149; 62/342; 366/110; 366/111

[58] Field of Search ..... 366/60, 53, 62, 63, 366/92, 93, 110, 111, 112, 125, 128, 140, 144, 145, 146, 149, 197, 200, 201, 204, 210, 211, 216, 220, 240, 331, 347, 602; 62/297, 331, 342

[56] References Cited

U.S. PATENT DOCUMENTS

| | | | |
|---|---|---|---|
| 1,769,890 | 7/1930 | Peters | 366/204 |
| 2,116,367 | 5/1938 | Smith | 366/111 |
| 2,762,613 | 9/1956 | Burton | 62/342 |
| 2,768,879 | 10/1956 | Hewson | 366/144 |
| 3,061,280 | 10/1962 | Kraft et al. | 366/110 |
| 3,159,384 | 12/1964 | Davis | 366/112 |
| 3,432,149 | 3/1969 | Stalberg et al. | 366/202 |
| 3,465,540 | 9/1969 | Carpigiani | 366/204 |
| 4,538,509 | 9/1985 | Ojima et al. | 366/144 |
| 4,555,183 | 11/1985 | Thomas | 366/208 |
| 4,848,917 | 7/1989 | Benin et al. | 366/110 |

FOREIGN PATENT DOCUMENTS

| | | | |
|---|---|---|---|
| 462370 | 1/1914 | France | 366/204 |
| 174866 | 11/1985 | Japan . | |

*Primary Examiner*—Timothy F. Simone

*Attorney, Agent, or Firm*—Fay, Sharpe, Beall, Fagan, Minnich & McKee

[57] ABSTRACT

A reagent vessel is mounted for swinging movement and has a projection at the bottom portion thereof. A rotor has an eccentric groove at an upper end and has an upper sealing member and a lower sealing member. A reagent refrigerator has a sealing at a bottom portion. The rotor is driven by a motor installed outside the refrigerator which moves up and down. When the rotor is disposed at a top dead point, the groove of the rotor engages with the projection of the vessel, then the rotor rotates and the reagent is mixed in swinging rotation. In this state, the lower sealing member of the rotor seals a bottom face of the sealing member of the refrigerator and prevents the water droplets falling down from the refrigerator from falling into the motor. When the rotor is disposed at a bottom dead point, the groove of the rotor disengages from the projection of the vessel. In this state, the upper sealing member of the rotor contacts an upper face of the sealing member of the refrigerator and the refrigerator is sealed.

15 Claims, 4 Drawing Sheets

MIXING APPARATUS FOR MIXING REAGENT FOR USE IN AUTOMATIC CHEMISTRY ANALYZER

BACKGROUND OF THE INVENTION

The present invention relates to a mixing apparatus for mixing a reagent for use in an automatic chemistry analyzer and, more particularly to a mixing apparatus for mixing a reagent for use in an automatic chemistry analyzer in which a sample and a reagent are reacted in a reaction cuvette and an analysis operation in the automatic chemistry analyzer is carried out.

The present invention relates to a mixing apparatus for mixing a reagent for use in an automatic chemistry analyzer in which a plurality of kinds of reagents corresponding to a plurality of measurement items are prepared on a reagent table and are successively supplied into reaction cuvettes on a reaction table so as to cause reactions between samples and the respective reagents thereby automatically analyzing the samples.

The automatic chemistry analyzer includes a reaction table, a sample table and a reagent table all arranged separately from each other. The automatic chemistry analyzer has a sample table having sample vessels and a reaction table coaxial with the sample table. The automatic chemistry analyzer also has a plurality of reagent vessels corresponding to different measurement items. In an analysis operation, the samples and the reagents are supplied into the reaction vessels by a pipetting apparatus.

The automatic chemistry analyzer according to the present invention is a biochemistry automatic chemistry analyzer or an immunology automatic chemistry analyzer etc..

In a conventional discrete type automatic chemistry analyzer, a reagent solution being received in a reagent vessel is pipetted into a reaction cuvette and a sample and a reagent are reacted in the reaction cuvette. The reagent solution that is pipetted into the reaction cuvette is required to be a homogeneous type solution.

However, recently there has been developed in the automatic chemistry analyzer field a method of dissolving tablets as a reagent immediately before the use thereof or a method of using a suspension solution in which an insoluble powder is suspended. In particular, a reagent consisting of small size particles having an antibody coated analyzer a reagent being coated an antibody at a small thereon has been utilized.

In this case, when the reagent is left in the mixing apparatus concentration of the reagent becomes non-uniform under this condition, a scattering of the reagent concentration is caused during the reagent solution pipetting operation, therefore it is impossible to practise correctly the analysis operation.

Accordingly, when a partly soluble reagent or an insoluble reagent for use in the automatic chemistry analyzer is used therein, it is indispensable to practise a mixing operation immediately after starting the automatic chemistry analyzer or immediately before beginning the reagent solution pipetting operation.

So as to realize a method of a reagent mixing operation for use in the automatic chemistry analyzer, there has been developed a method of swinging a reagent vessel over a reagent refrigerator and a method of mixing a reagent with a magnetized stirrer inserted in a reagent vessel with a fluctuating magnetic field applied from the outside of the reagent vessel. Further, there has been developed a method of rotating a reagent vessel in which an outer wall of the reagent vessel is contacted to a driving apparatus.

Further, there has been developed a method of rotating a reagent cuvette in which the reagent cuvette is rotated by an eccentric structure stirrer as shown in Japanese Utility Model Laid-Open No. 17488/1980. The eccentric structure stirrer is mounted on a top portion of a rotating shaft which can move up-and-down. The stirrer is provided to be not co-axial with an axis of the reagent cuvette and moves up-and-down. A round bottom portion of the reagent cuvette is disposed on an upper convex portion of the eccentric structure stirrer and is rotated by the eccentric structure stirrer.

However, since a reagent cuvette supporter is inserted as a supporter at an upper end portion of the reagent cuvette, during a rotating mixing operation the reagent solution rises in the reagent cuvette, spills out of the cuvette, and adheres to the reagent cuvette supporter. As the round bottom portion of the reagent cuvette is supported by the convex portion of the stirrer, an engagement relationship between the stirrer and the reagent cuvette becomes unstable. Further, since a shaft for a solenoid rotates synchronously, an abrasion of the shaft occurs.

SUMMARY OF THE INVENTION

An object of the present invention is to provide a mixing apparatus for mixing a reagent for use in an automatic chemistry analyzer wherein a reagent vessel disposed in a reagent refrigerator can be mixed outside of the reagent refrigerator with an improved reagent mixing apparatus.

Another object of the present invention is to provide a mixing apparatus for mixing a reagent for use in an automatic chemistry analyzer wherein cold air can be prevented from leaking out of the reagent refrigerator.

In accordance with the present invention, a mixing apparatus for mixing a reagent for use in an automatic chemistry analyzer comprises a reagent refrigerator, a reagent table extending into the reagent refrigerator, a reagent vessel is mounted the reagent table and received in the reagent refrigerator, and a mixing apparatus for mixing a solution in the reagent vessel in accordance with a movement of the reagent vessel, the mixing apparatus having a rotor disposed in the reagent refrigerator and a rotor driving apparatus mounted outside the refrigerator for rotating the rotor.

The reagent vessel is mounted for swinging movement with respect to the reagent table, and the rotor is disposed in the reagent refrigerator and moves up-and-down. The reagent vessel has a first engagement member at a bottom face of the reagent vessel, the rotor has a second engagement member at a top face of the rotor. The second engagement member of the rotor is engaged with or disengaged from the first engagement member of the reagent vessel.

A first sealing member for sealing in cold air in the reagent refrigerator is fixed on a rotating shaft of the rotor at a lower face of the reagent refrigerator, and a second sealing member for preventing water droplets from falling down from the reagent refrigerator outside of the mixing apparatus is fixed on the rotating shaft of the rotor at a bottom portion of the reagent refrigerator.

In accordance with the mixing apparatus structure of the present invention, the reagent vessel is mounted to swing or shake with respect on the reagent table which extends into the reagent refrigerator. The rotor is disposed in the reagent refrigerator and has a groove member which engages with or disengages from a projection member mounted on a bottom portion of the reagent vessel. A driving apparatus for rotating the rotor is installed outside the reagent refrigerator, and a rotating shaft of the driving apparatus is connected to the rotor.

One sealing member is installed fixedly to a lower portion of the reagent refrigerator, another sealing member is mounted to the rotating shaft of the driving apparatus, both sealing members are disposed to be able to a face and contact one another, when the driving apparatus and the rotor are descended respectively and the reagent vessel and the rotor are separated from each. Thus, sealing for the cold air is attained.

The reagent vessel containing a reagent is transferred by a reagent transferring apparatus. Only the reagent necessary for an analysis operation is transferred selectively to a reagent absorption position and transferred to a setting position for the rotor immediately before a reagent solution pipetting operation motion.

The rotor is positioned and stopped usually at a bottom dead point of the rotor, however when a predetermined reagent vessel is transferred at a predetermined mixing position then the rotor is ascended. When the rotor reaches a top dead point of the rotor, the rotor is stopped at the top dead point and successively the rotor is rotated a predetermined time.

In a desirable embodiment according to the present invention, since only a lower end portion of the reagent vessel is supported by the projection portion provided on the bottom portion thereof, the position of the projection portion of the reagent vessel may vary within the groove member provided on the upper face of the rotor.

However the upper face (opening portion) of the groove member of the rotor has an opening radius and the opening radius of the upper face of the groove member of the rotor is set to be large enough to cover the swingable range of the reagent vessel. The projection portion of the reagent vessel is received easily into the groove member of the rotor according to the ascent of the rotor.

Further the groove member of the rotor is formed eccentrically with the rotating radius of the reagent vessel and connected smoothly to the circular bottom portion of the groove member of the rotor which has an opening radius larger than the diameter of the projection portion of the reagent vessel.

Therefore the projection portion of the reagent vessel which has been received into the groove member opening portion of the rotor is led into the groove member bottom portion of the rotor along the smoothly connecting portion of the rotor in accordance with the ascent of the rotor.

Accordingly, the projection portion of the reagent vessel (the lower end portion of the reagent vessel) has an accuracy dimension having a gap range which is formed between the diameter of the projection portion of the reagent vessel and the opening diameter of the groove member bottom portion of the rotor. The projection portion of the reagent vessel is maintained at the eccentrically rotating position which has a predetermined rotation radius with the rotation center of the rotor.

In this state, when the rotor is driven, the rotor can rotate because of the projection portion of the reagent vessel being held in the groove member bottom portion of the rotor. The reagent vessel is rotated with a predetermined time having a predetermined rotating radius and also with a predetermined rotating number, thereby the uniform mixing operation for the reagent solution in the reagent vessel in the automatic chemistry analyzer can be carried out.

When the mixing operation for the reagent solution has been carried out for a predetermined time in the reagent vessel, the rotation of the rotor is made to stop and then the rotor is made to descend to the bottom dead point of the rotor. The rotor stops and stays at this bottom dead point.

When the rotor is moved and reaches the bottom dead point thereof, the reagent which has been mixed is pipetted by the pipetting apparatus. Next, the following reagent is transferred to the mixing position of the automatic chemistry analyzer and the above stated mixing operation for the reagent is carried out repeatedly. According to this mixing operation for the reagent in the mixing apparatus, it is possible to mix each reagent individually.

In the present invention, the sealing member is adhered to the lower face of the reagent refrigerator so that the cold air from the hole portion provided at the bottom portion of the reagent refrigerator can escape through the gap portion which is formed between the rotor and the reagent refrigerator during the mixing operation for the reagent. Accordingly, there exists the heat conduction by the rotor alone.

A preferable embodiment of the present invention has a following mixing apparatus structure. Namely, the reagent vessel for receiving the reagent solution containing the reagent is set on the reagent transferring apparatus which transfers successively the reagent vessel. Each of the reagent vessels is made to supported at only one lower end portion thereof so that it can swing and shake. The reagent vessel has a projection portion at the bottom portion thereof.

The rotor is provided to ascend or descend toward predetermined positions. Further the rotor is provided to hold the projection portion of the reagent vessel at the upper face thereof.

An opening portion of the rotor is formed to have a circular shape large enough to cover the swingable range of the projection portion of the reagent vessel. At the bottom portion of the opening portion of the rotor, the rotor has a smaller circular shape groove member. The smaller circular shape groove member of the rotor is positioned eccentrically at the center of the circular shape opening portion of the rotor with a rate of the rotation radius of the projection portion of the reagent vessel and also has a diameter larger than the dimension of the projection portion of the reagent vessel.

A sealing member having a through-hole with an opening diameter larger than an outer diameter of the rotor is set so that the rotor has is inserted into the through-hole of the sealing member.

A thin sealing member made of a rubber material etc. is provided on the middle portion of the rotor and covers fully a clearance formed between the throughhole of the sealing member and the rotor when the rotor is moved to the bottom dead point of the rotor.

When the rotor is not rotating, the thin sealing member seals the clearance formed between the throughhole of the sealing member and the rotor, and the cold air can escape or leak out only during the reagent mixing operation.

Further since the only member being inserted in the reagent refrigerator is the rotor, the material for forming the rotor can be a resin material member having a low heat conducting rate. Accordingly, the heat loss of the rotor due to the heat conduction can be reduced and the occurrence of corrosion on the rotor according to condensation droplets etc. can be prevented.

According to the present invention, since the driving apparatus for the mixing apparatus is installed outside the reagent refrigerator the heat produced by the driving apparatus for the mixing apparatus is isolated from the reagent refrigerator. Accordingly the cooling temperature control in the mixing apparatus can be carried out easily.

Further, it is possible to reduce the leakage of the cold air from the reagent refrigerator with a simple structure, so that a small cooling control apparatus for the mixing apparatus can be attained.

DESCRIPTION OF THE INVENTION

One embodiment of a mixing apparatus for mixing a reagent for use in an automatic chemistry analyzer according to the present invention will be explained as follows.

Figure 1:
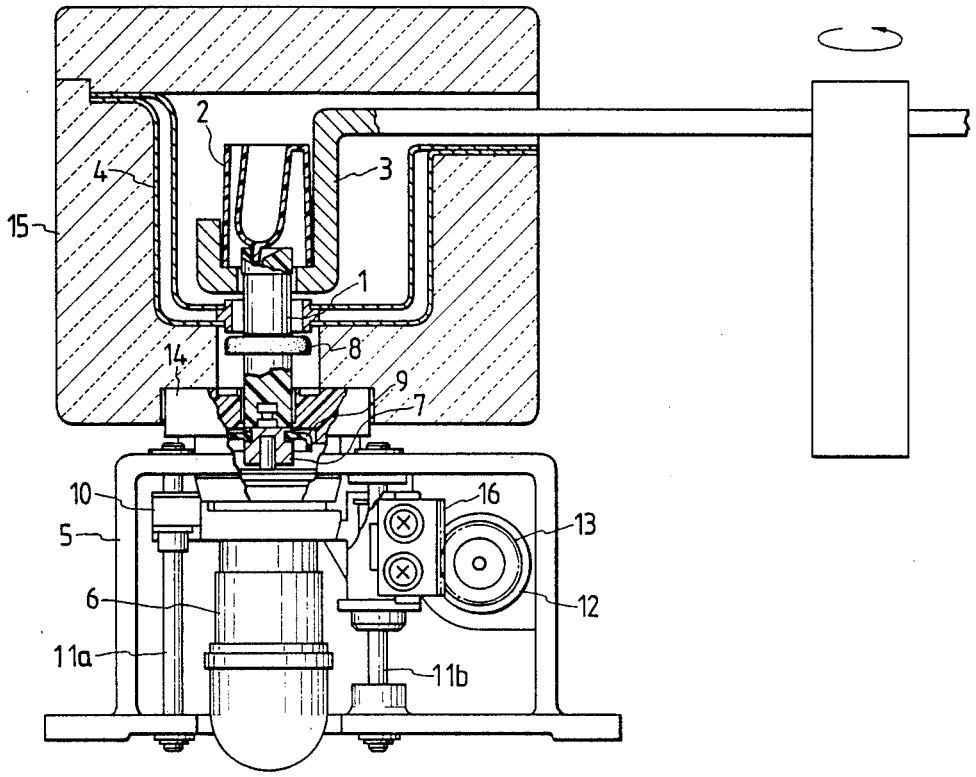
FIG. 1 is a side elevation view, partially in section, of one embodiment of a mixing apparatus for mixing a reagent for use in an automatic chemistry analyzer according to the present invention.

FIG. 1 shows a mixing apparatus structure of one embodiment according to the present invention. A reagent vessel 2 is set in a reagent table 3 for transferring a reagent by a rotational movement thereof. The reagent vessel 2 and the reagent table 3 are installed respectively in a reagent refrigerator 4 and maintained within a cold state therein.

A mixing apparatus for mixing a reagent in the reagent vessel 2 is mounted on a base 5. A rotor 1 of the mixing apparatus is made of a synthetic resin material member and manufactured through a synthetic resin molding process.

A metal fitting 7 is mounted at a connecting portion of the rotor 1 with a motor 6. The motor 6 is provided to rotate the rotor 1 of the mixing apparatus and is mounted on just under a lower end portion of the metal fitting 7. The rotor 1 is fixed to the shaft of the motor 6 via the metal fitting 7.

A first sealing member 8, which is made of a rubber material or a vinyl chloride resin material, for sealing in cold air in the reagent refrigerator 4 is mounted on a middle portion of the rotor 1. A second sealing member 9, which is made of a rubber material or a vinyl chloride resin material, for preventing a fall-down of water droplets is mounted on an end portion of the rotor 1 and has the same shape of the first sealing member 8.

A first guide shaft **11*a* and a second guide shaft 11*b* for guiding a slider 10 are installed respectively on the base 5. The slider 10 extends across the first guide shaft 11*a* and the second guide shaft 11*b*. The motor 6 is fixed to the slider 10. The slider 10 is guided by the first guide shaft 11*a* and the second guide shaft 11*b*** so that it can move up and down.

A rack gear 16 is fixed to the slider 10. The slider 10 is driven toward the upper direction and the lower direction by an up-and-down motion driving motor 12 via the rack gear 16 and a pinion gear 13 being mounted on a rotating shaft of the up-and-down motion driving motor 12.

A third sealing member 14 made of a vinyl chloride resin material is fixed to an upper portion of the base 5 and is disposed on a lower portion of the reagent refrigerator 4. The third sealing member 14 surrounds an outer peripheral portion of the rotor 1 and is adhered to a bottom hollow portion of a heat insulating material member 15. The heat insulating material member 15 covers an outer peripheral wall portion and an upper wall portion of the reagent refrigerator 4 as shown in FIG. 1.

Figure 4:
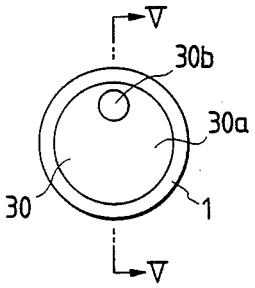
FIG. 4 is a plan view showing a rotor used in the embodiment shown in FIG. 1 according to the present invention.
Figure 5:
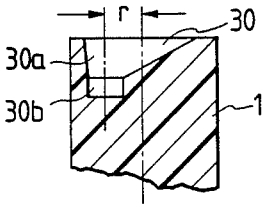
FIG. 5 is a cross-sectional partial view showing a rotor taken along a line V—V in FIG. 4.

FIG. 4 is a plan view showing the rotor 1 which is used in this embodiment of the present invention, and FIG. 5 is a cross-sectional view showing the rotor 1.

The rotor 1 has a convex groove 30 at an upper end portion thereof. The convex groove 30 of the rotor 1 comprises an upper circular large opening portion **30*a* having an opening diameter (D) and a bottom circular small opening portion 30*b* having an opening diameter (d) as shown in FIG. 4 and FIG. 5**.

A center of the upper circular large opening portion **30*a* and a center of the bottom circular small opening portion 30*b* of the convex groove 30 are not co-axial and are separated with an eccentric amount (r) as shown in FIG. 5. The convex groove 30 of the rotor 1 is formed smoothly in a depth direction with the upper circular large opening portion 30*a* and the bottom circular small opening portion 30*b***.

The rotor 1 rotates about at a center of the upper circular large opening portion **30*a* as a rotating axis therefor. The eccentric amount (r) between the upper circular large opening portion 30*a* and the bottom circular small opening portion 30*b* is determined to correspond to a rotation radius of the reagent vessel 2**.

Figure 6:
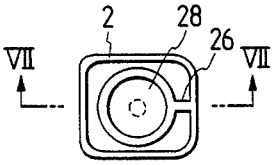
FIG. 6 is a plan view showing a reagent vessel used in the embodiment shown in FIG. 1 according to the present invention.
Figure 7:
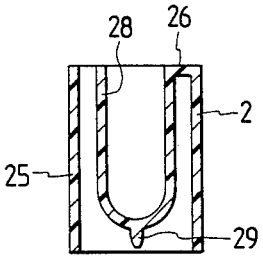
FIG. 7 is a cross-sectional view showing a reagent vessel taken along a line VII—VII in FIG. 6.

FIG. 6 is a plan view showing the reagent vessel 2 which is used in this embodiment of the present invention, and FIG. 7 is a cross-sectional view showing the reagent vessel 2.

The reagent vessel 2 is made of a soft synthetic resin material and formed through a synthetic resin molding process. Since the reagent vessel 2 is made of the soft synthetic resin material, it can move easily and swingingly.

The reagent vessel 2 comprises an outer surrounding frame portion 25, a thin bar shape connecting portion 26, a reagent solution receiving portion 28, and a projecting portion 29 as shown in FIG. 6 and FIG. 7. The reagent solution receiving portion 28 of the reagent vessel 2 is surrounded by the outer surrounding frame portion 25 at an outer peripheral portion thereof. The thin bar shape connecting portion 26 of the reagent vessel 2 is formed integrally with the outer surrounding frame portion 25 and the reagent solution receiving portion 28.

The reagent solution receiving portion 28 of the reagent vessel 2 is connected to the outer surrounding frame portion 25 with the thin bar shape connecting portion 26 alone. The projecting portion 29 of the reagent vessel 2 is formed integrally at a bottom central portion of the reagent solution receiving portion 28.

Figure 3:
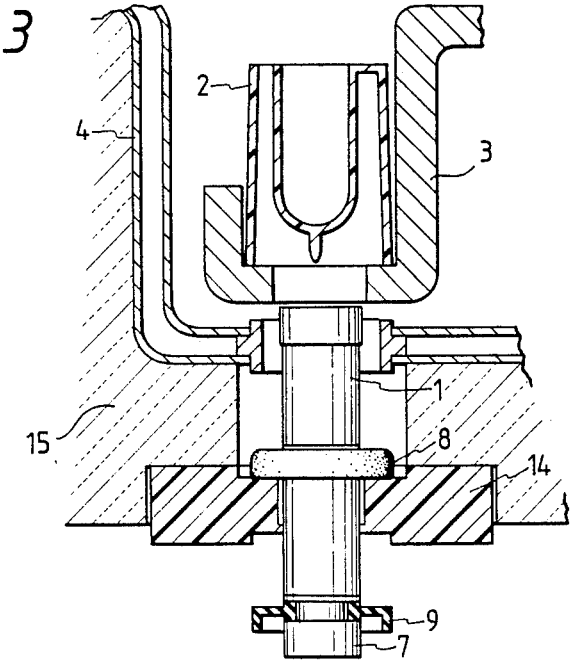
FIG. 3 is a side view of a mixing apparatus, partially in section, in which a rotor is positioned at a bottom dead point.

When the mixing operation by the mixing apparatus is not practised, the slider 10 is maintained at a descended position, and then the rotor 1 is positioned at a bottom dead point and remains at a stopped state as shown in FIG. 3. In this state, since the upper end face of the rotor 1 is positioned below a lower end portion of the reagent disc 3, the reagent disc 3 can rotate freely.

Since a lower face of the first sealing member 8 is close to and contacts an upper face of the third sealing member 14, and the first sealing member 8 presents a stick state with the upper face of the third sealing member 14, thereby the flow-out of the cold air in the reagent refrigerator 4 is shut off completely from the above-stated stick state portion or a clearance between the inner peripheral portion of the third sealing member 14 and the outer peripheral portion of the rotor 1.

In accordance with the rotation operation of the reagent disc 3, when the reagent vessel 2 to be mixed is positioned at a mixing position, the rotor 1 is ascended by the up-and-down motion driving motor 12 via the pinion gear 13 and the rack gear 16. The convex groove 30 of the rotor 1 receives the projecting portion 29 of the reagent vessel 2.

In this case, even if the position of the projecting portion 29 of the reagent vessel 2 is scattered a little, since an opening area of the convex groove 30 of the rotor 1 is larger comparatively than a projection cross-sectional area of the projecting portion 29 of the reagent vessel 2, the projecting portion 29 of the reagent vessel 2 can be received easily in the convex groove 30 of the rotor 1.

Figure 2:
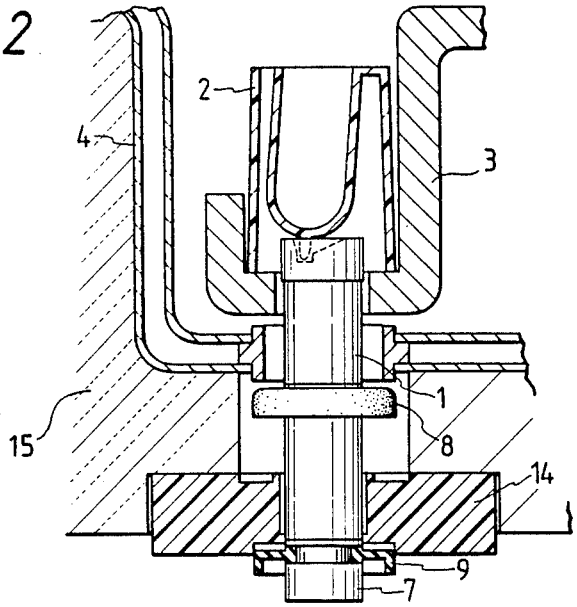
FIG. 2 is a side view of a mixing apparatus, partially in section, in which a rotor is positioned at a top dead point.

The rotor 1 is ascended further, and after the rotor 1 is stopped at a top dead point of the rotor 1, the projecting portion 29 of the reagent vessel 2 moves along a connection face for connecting the upper circular large opening portion 30*a* of the rotor 1 and the bottom portion of the bottom circular small opening portion 30*b* of the rotor 1. As a result, the projecting portion 29 of the reagent vessel 2 is received in the bottom circular small opening portion 30*b* of the convex groove 30 of the rotor 1 and is maintained with an inclined state for the rotation radius as shown in FIG. 1 and FIG. 2.

In this state, in accordance with the motor 6 rotating at a predetermined rotation number, since the rotor 1 in which the projecting portion 29 of the reagent vessel 2 is held in the bottom circular small opening portion 30*b* of the convex groove 30 of the rotor 1 can rotate simultaneously with the motor 6, then the reagent vessel 2 can rotate at a predetermined rotation radius and also at a predetermined rotation number. Accordingly, the solution received in the reagent solution receiving portion 28 of the reagent vessel 2 can be mixed therein.

The first sealing member 8 is ascended simultaneously with the ascent of the rotor 1. The lower face portion of the first sealing member 8 is separated from the upper face portion of the third sealing member 14. During the rotation operation of the reagent vessel 2, the cold air escapes or leaks out from a clearance between an inner peripheral portion of the third sealing member 14 and an outer peripheral portion of the rotor 1.

In this embodiment of the present invention, the second sealing member 9 is provided so as to prevent the falling down of the water droplets into the motor 6. Namely, when the cold air that leaks out from the clearance between the inner peripheral portion of the third sealing member 14 and the outer peripheral portion of the rotor 1 contacts the outside air and causes condensation, the water droplets adhere to an outer face portion of the second sealing member 9.

The adhered water droplets are collected in a groove of a reservoir (not shown in drawing) provided on an upper face portion of the slider 10 via an outer edge portion of the second sealing member 9. The collected water droplets evaporate naturally, therefore the occurrence of an accident such as corrosion etc. due to the water droplets flowing into the rotating shaft of the motor 6 etc. can be prevented.

After the reagent has been mixed in the reagent vessel 2 at a predetermined time, the rotation of the motor 6 is stopped. Continuously, the rotor 1 of the mixing apparatus is descended according to the motion of the up-and-down motion driving motor 12.

After the movement for reaching to the bottom dead point of the rotor 1 has been checked, the reagent disc 3 is rotated, and a following reagent vessel 2 being mixed is transferred to the predetermined position to be mixed. The movement and the mixing operation for the reagent with the following reagent vessel 2 is practised similarly.

Figure 8:
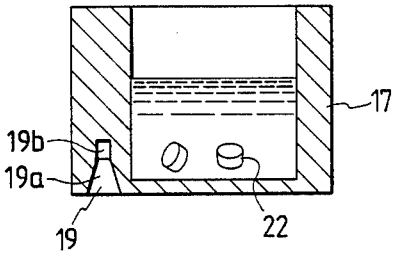
FIG. 8 is a cross-sectional view showing another reagent vessel used in another embodiment according to the present invention.
Figure 9:
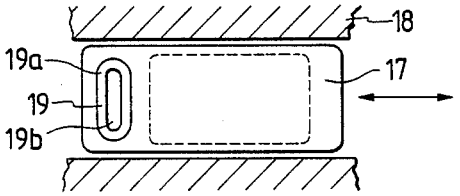
FIG. 9 is a bottom plan view of the reagent vessel shown in FIG. 8.
Figure 10:
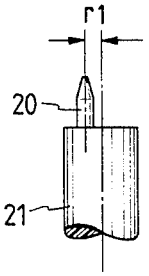
FIG. 10 is a side view showing another rotor according to the present invention which engages with the reagent vessel shown in FIG. 8.

FIG. 8–FIG. 10 show another reagent vessel structure and another rotor structure for mixing apparatus for mixing a reagent for use in an automatic chemistry analyzer according to another embodiment of the present invention.

FIG. 8 is a cross-sectional view showing a reagent vessel 17, and FIG. 9 is a bottom plan view showing the reagent vessel 17. FIG. 10 is a partial view showing a rotor 21 being engaged with the reagent vessel 17.

The reagent vessel 17 contains tablets 22 in the buffer solution at an interior portion thereof. The reagent vessel 17 is disposed within a holder 18. The reagent vessel 17 is engaged with the holder 18 to be able to slide or shake therebetween as shown in the direction shown by the arrow in FIG. 9.

An elliptical shaped groove 19 is formed in one end side of a bottom portion of the reagent vessel 17. The elliptical shaped groove 19 comprises a large elliptical shape groove 19*a* and a small elliptical shaped groove 19*b* which is formed at a central portion of a bottom portion of the large elliptical shaped groove 19*a*.

The rotor 21 has a projecting pin 20 at an upper end portion thereof. The projecting pin 20 of the rotor 21 is not coaxial with the center axis of the rotor 21 and is separated by an eccentric amount (r1). The projecting pin 20 of the rotor 21 engages with the elliptical shaped groove 19 of the reagent vessel 17.

In accordance with the rotation of the rotor 21, the reagent vessel 17 moves reciprocally in the direction of the arrow shown in FIG. 9 with the projecting pin 20 of the rotor 21 engaging with the small elliptical shaped groove **19*b* of the reagent vessel 17. Accordingly the tablets 22 in the reagent vessel 17** are mixed and dissolved easily by the buffer solution in accordance with the mixing operation of the mixing apparatus.

We claim:

1. A mixing apparatus for mixing a reagent for use in an automatic chemistry analyzer comprising a reagent refrigerator, a reagent table extending into said reagent refrigerator, a reagent vessel installed on said reagent table and received in said reagent refrigerator, and a mixing apparatus for mixing a solution in said reagent vessel in accordance with movement of said reagent vessel, said mixing apparatus having a rotor disposed in said reagent refrigerator and a rotor driving apparatus for rotating said rotor, wherein:

said reagent vessel is installed on said reagent table, said rotor is disposed in said reagent refrigerator and is moved in an up-and-down direction by moving means, said reagent vessel has a first engagement member at a bottom face of said reagent vessel, said rotor has a second engagement member at a top face of said rotor, said second engagement member of said rotor is engaged with or disengaged from said first engagement member of said reagent vessel, said rotor driving apparatus is installed outside said reagent refrigerator, a first sealing member for sealing cold air in said reagent refrigerator is fixed on a rotating shaft of said rotor at a lower face of said reagent refrigerator, and a second sealing member for preventing water droplets from falling down from said reagent refrigerator outside of said mixing apparatus is fixed on said rotating shaft of said rotor at a bottom portion of said reagent refrigerator.

2. A mixing apparatus for mixing a reagent for use in an automatic chemistry analyzer according to claim 1, wherein said moving means moves said rotor driving apparatus in an up-and-down direction to move said rotor up and down.

3. A mixing apparatus for mixing a reagent for use in an automatic chemistry analyzer according to claim 1, wherein said first engagement member of said reagent vessel is a projection member, and said second engagement member of said rotor is a groove member, and said groove member of said rotor is engaged with said projection member of said reagent vessel.

4. A mixing apparatus for mixing a reagent for use in an automatic chemistry analyzer according to claim 1, wherein said first engagement member of said reagent vessel is a groove member, said second engagement member of said rotor is a projection member, and said projection member of said rotor is disengaged from said groove member of said reagent vessel.

5. A mixing apparatus for mixing a reagent for use in an automatic chemistry analyzer according to claim 1, wherein said rotor is made of a synthetic resin material member.

6. A mixing apparatus for mixing a reagent for use in an automatic chemistry analyzer according to claim 1, wherein said first sealing member fixed on said rotating shaft of said rotor seals a clearance formed between said reagent refrigerator and said rotating shaft of said rotor.

7. A mixing apparatus for mixing a reagent for use in an automatic chemistry analyzer according to claim 1, wherein said reagent refrigerator has a third sealing member at a bottom face of said reagent refrigerator.

8. A mixing apparatus for mixing a reagent for use in an automatic chemistry analyzer according to claim 7, wherein said second sealing member fixed on said rotating shaft of said rotor seals a bottom face of said third sealing member disposed on said reagent refrigerator so as to prevent the water droplets from falling down from said reagent refrigerator toward an outside of said mixing apparatus and onto said rotor driving apparatus.

9. A mixing apparatus for mixing a reagent for use in an automatic chemistry analyzer according to claim 7, wherein said third sealing member disposed on said reagent refrigerator is provided on a bottom face of a heat insulating material member, said heat insulating material member surrounds said reagent refrigerator, and said rotor penetrates into said third sealing member.

10. A mixing apparatus for mixing a reagent for use in an automatic chemistry analyzer according to claim 7, wherein said second engagement member is a groove member and said first engagement member is a projection member such that when said rotor is disposed at a top dead point by said moving means, said groove member of said rotor is engaged with said projection member of said reagent vessel, and said second sealing member is placed in contact with a bottom face of said third sealing member, whereby water droplets falling down from said reagent refrigerator toward the outside of said mixing apparatus are prevented from contacting said rotor driving apparatus.

11. A mixing apparatus for mixing a reagent for use in an automatic chemistry analyzer according to claim 7, wherein said second engagement member is a groove member and said first engagement member is a projection member such that when said rotor is disposed at a bottom dead point by said moving means, said groove member of said rotor is disengaged from said projection member of said reagent vessel, and said first sealing member is placed in contact with an upper face of said third sealing member, whereby cold air in said reagent refrigerator is sealed therein.

12. A mixing apparatus for mixing a reagent for use in an automatic chemistry analyzer comprising a reagent refrigerator, a reagent table extending into said reagent refrigerator, a reagent vessel installed on said reagent table and received in said reagent refrigerator, a heat insulating material member surrounding said reagent refrigerator, and a mixing apparatus for mixing a solution in said reagent vessel in accordance with a movement of said reagent vessel, said mixing apparatus having a rotor disposed in said reagent refrigerator and a rotor driving apparatus for rotating said rotor, wherein:

said reagent vessel is installed on said reagent table, said rotor is disposed in said reagent refrigerator and is moved in an up-and-down direction by moving means, said reagent vessel has a first engagement member at a bottom face of said reagent vessel, said rotor has a second engagement member at a top face of said rotor, said second engagement member of said rotor is engaged with or disengaged from said first engagement member of said reagent vessel, said first engagement member of said reagent vessel is one of a projection member and a groove member, and said second engagement member of said rotor is the other of said groove member and projection member, said one of said groove member and said projection member of said rotor is engaged with or disengaged from said other of said groove member and projection member of said reagent vessel, said rotor driving apparatus is installed outside of said reagent refrigerator and is moved by said moving means in an up-and-down direction, a first sealing member for sealing cold air in said reagent refrigerator is fixed on a rotating shaft of said rotor at a lower face of said reagent refrigerator, and a second sealing member for preventing water droplets from falling down onto said rotor driving apparatus from said reagent refrigerator outside of said mixing apparatus is fixed on said rotating shaft of said rotor at a bottom face of said reagent refrigerator.

13. A mixing apparatus for mixing a reagent for use in an automatic chemistry analyzer according to claim 12, wherein a third sealing member is provided on a bottom face of said heat insulating material member, and said rotor penetrates into said third sealing member.

14. A mixing apparatus for mixing a reagent for use in an automatic chemistry analyzer according to claim 13, wherein when said rotor is disposed at a top dead point by said rotor driving apparatus, said one of said groove member and said projection member of said rotor is engaged with said other of said groove member and said projection member of said reagent vessel, and said second sealing member is placed in contact with a bottom face of said third sealing member, whereby water droplets falling down from said reagent refrigerator toward the outside of said mixing apparatus are prevented from contacting said rotor driving apparatus.

15. A mixing apparatus for mixing a reagent for use in an automatic chemistry analyzer according to claim 13, wherein when said rotor is disposed at a bottom dead point by said rotor driving apparatus, said one of said groove member and said projection member of said rotor is disengaged from said other of said groove member and said projection member of said reagent vessel, and said first sealing member is placed in contact with an upper face of said third sealing member, whereby cold air in said reagent refrigerator is sealed therein.

* * * * *